United States Patent [19]

Mauratelli

[11] Patent Number: 4,480,822

[45] Date of Patent: Nov. 6, 1984

[54] ANNEALING FURNACE SYSTEM

[76] Inventor: Luigi Mauratelli, Via Covetta 7, P.O. Box 85, 54031 Avenza MS, Italy

[21] Appl. No.: 386,347

[22] Filed: Jun. 9, 1982

Related U.S. Application Data

[62] Division of Ser. No. 234,268, Feb. 13, 1981.

[51] Int. Cl.[3] ..... F27D 1/00

[52] U.S. Cl. ..... 266/256; 266/249; 266/252

[58] Field of Search ..... 266/256, 249, 255, 257, 266/252, 251

[56] References Cited

U.S. PATENT DOCUMENTS

| | | | |
|---|---|---|---|
| 2,258,431 | 10/1941 | Wellman | 266/256 |
| 3,993,433 | 11/1976 | Isaksson et al. | 266/249 |
| 4,245,818 | 1/1981 | Elhaus et al. | 266/255 |

FOREIGN PATENT DOCUMENTS

| | | | |
|---|---|---|---|
| 577061 | 5/1946 | United Kingdom . | |
| 600715 | 4/1948 | United Kingdom | 266/256 |

*Primary Examiner*—L. Dewayne Rutledge
*Assistant Examiner*—S. Kastler
*Attorney, Agent, or Firm*—Joseph H. Golant

[57] ABSTRACT

A furnace system is described having a rotatable table with five stations, a loading station, a preheating station, a heating station, a cooling station and an unloading station. A furnace having three compartments, a preheating compartment, a heating compartment and a cooling compartment is vertically movable so that a steel charge to be annealed located on the rotatable table may be moved from one station to another when the furnace is lifted out of contact with the table. Air ducts are provided to transfer heated air from the cooling station to the preheating station. The system is very efficient for, when one charge is cooling a succeeding charge is being heated while the next succeeding charge is being preheated. At the same time a charge can be loaded and another charge can be unloaded. Thus, five steps of an annealing cycle can be accomplished simultaneously allowing an annealed charge to be completely cycled during each step.

10 Claims, 7 Drawing Figures

ANNEALING FURNACE SYSTEM

This is a division of application Ser. No. 234,268, filed Feb. 13, 1981.

BACKGROUND OF THE INVENTION

1. Field of the Invention

This invention relates to annealing furnaces and methods of annealing and, in particular, to an efficient furnace that can anneal steel laminations without inducing distortions therein and to a method for quickly and efficiently annealing steel.

2. Prior Art

In annealing, a material is heated to a predetermined elevated temperature, temporarily held at that temperature, and then cooled to room temperature. This heat treatment changes some of the physical properties of the material; most notably, hardness is reduced.

Although glass may be annealed, this invention is primarily concerned with annealing metals, and particularly concerned with annealing steel.

It is frequently desirable to anneal steel laminations for use in electric motors and electric transformers. Typically low carbon silicon steel is used for these applications. If the steel laminations are eventually going to be used in transformers, it is necessary that the steel have a quality known as oriented grain. On the other hand if the end use of the steel lamination will be in an electric motor, non-oriented grain steel is required. In either case, it is extremely important that the sides of the laminations be planar after annealing. This is necessary to insure uniform and predictable magnetic fields and their effects about and upon the transformers and electric motors.

At present, the method of annealing steel entails the insertion of the material to be annealed (commonly called a charge) into a furnace operating at a high temperature. The charge is placed into the furnace at room temperature and remains in the furnace until its temperature has been raised to that of the furnace. After a predetermined time, the charge is removed from the furnace and allowed to cool.

Strain fields may be present in the charge to be annealed. These fields, which extend over long distances on an atomic scale, represent a certain amount of strain energy of the charge. During annealing these fields are rearranged into configurations of lower strain energy, with the rearrangement frequently causing distortions in the shape of the charge. These distortions may adversely affect the planarity of the steel laminations rendering them unsuitable for electrical uses.

One of the difficulties with present annealing furnaces is that they can not prevent the loss in planarity that frequently accompanies annealing steel laminations.

Another disadvantage of prior art annealing furnaces is that they require a large amount of energy to anneal each charge. These furnaces are particularly inefficient in that the heat released by the cooling charge is wasted. In addition, each charge successively is heated from room temperature which requires considerable time and energy.

The time required to anneal each charge presents another disadvantage in prior art furnaces. Since each charge must be heated and cooled before the next charge enters the furnace the annealing cycle is correspondingly longer than if the charges were cooled outside the furnace.

SUMMARY OF THE INVENTION

The present invention eliminates the distortion problems mentioned above and provides an annealing furnace that is more energy efficient and has a shorter annealing cycle than prior art furnaces.

The invention may be summarized as a furnace system comprising a preheating station for initially raising the temperature of the charge, a heating station for bringing the temperature of the charge to its desired level, a cooling station for allowing the temperature of the charge to be reduced, and duct means for transferring the thermal energy of the heated charge from the cooling station to the preheating station.

The invention may be further summarized as an annealing method characterized by the steps of; (1) heating the charge in a heating station of a furnace, (2) allowing the charge to cool in a cooling station of a furnace, (3) preheating the next charge to be annealed in a preheating station of a furnace with the heat of the cooling charge, (4) moving the charge of step (3) into the heating station of the furnace and repeating steps (1) through (4).

A basic object of the present invention is to provide a reliable annealing furnace and a method for annealing that are more energy efficient than prior art furnaces and methods.

Another object of the present invention is to provide an annealing furnace and method that will not distort the charge regardless of the heating rate.

A further object of the present invention is to provide an annealing furnace and method for annealing that preheat the charge to be annealed.

An aim of the present invention is to provide an annealing furnace and a method of annealing that recycle the thermal energy released by the cooling charge.

An additional object of the present invention is to provide an annealing furnace and method with a shorter annealing cycle.

Another related aspect of the present invention is to provide an annealing furnace with a higher production capability per day than conventional furnaces.

Still another aim of the present invention is to provide an annealing furnace that adjustably applies pressure to the charge.

A further aim of the present invention is to provide an annealing furnace that uses a linear electric supply.

An additional object of the present invention is to provide an energy saving, relatively quick annealing furnace that is simple to construct and easy to operate.

The foregoing objects, advantages, features and results of the present invention together with various other objects, advantages, features and results thereof which will be evident to those skilled in the art in light of this disclosure may be achieved with the exemplary embodiment of the invention described in detail hereinafter and illustrated in the accompanying drawings.

DESCRIPTION OF THE PREFERRED EMBODIMENT

Figure 1:
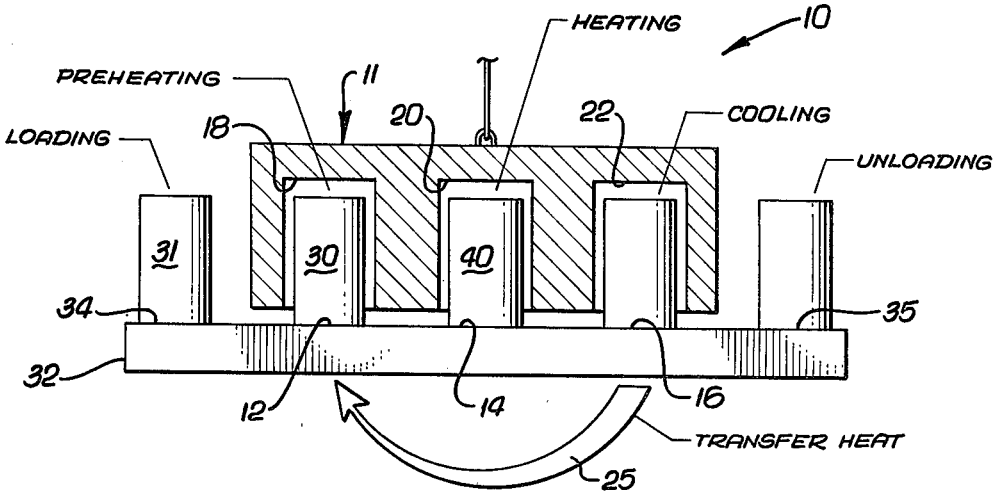
FIG. 1 is an elevational diagrammatic view of the subject furnace showing the furnace compartments in the lowered position.

While the present invention is susceptible to various modifications and alternative constructions, an embodiment is shown in the drawings and will be described in detail herein. It should be understood, however, that it is not the intention to limit the invention to the particular forms disclosed; but, on the contrary, the intention is to cover all modifications, equivalences and alternative constructions falling within the spirit and scope of the invention as expressed in the appended claims.

It will be appreciated that what is described herein is an energy efficient, relatively simple to construct and easy to operate annealing furnace that saves up to 38% of the energy used by conventional annealing furnaces.

Referring to FIG. 1, a furnace system 10 is shown in diagrammatic form having five stations including a preheating station 12, a heating station 14, and a cooling station 16. A furnace 11 includes three insulated compartments each associated with corresponding furnace stations, namely, a preheating compartment 18, a heating compartment 20, and a cooling compartment 22.

The present invention saves considerable amounts of time and energy by utilizing the heat of the cooling charge to preheat another charge before it enters the heating station of the furnace. This thermal energy transfer is facilitated by a pair of ducts 24 and 26 and a fan 28 (FIG. 4), this transfer being represented by an arrow 25 in FIG. 1. The ducts allow the preheating compartment 18 to communicate with the cooling compartment 22. The ducts are insulated and positioned beneath the two furnace compartments whereby turbulant flow is obtained. The irregular eddying motions that comprise turbulance are very effective in promoting transport of the heat.

It will become apparent from FIG. 1 that the charge successively enters one furnace station after the other to undergo three phases in its annealing cycle. As described in more detail below, it is the three phase annealing cycle that yields the tremendous savings. In addition to providing energy savings, preheating the charge increases the per day output of the furnace system. In this regard, one charge is preheating at the same time as another charge is being heated to its peak temperature. Needless to say it requires less time to heat a preheated charge to a peak temperature than to heat a charge at or near room temperature to the peak temperature.

Figure 2:
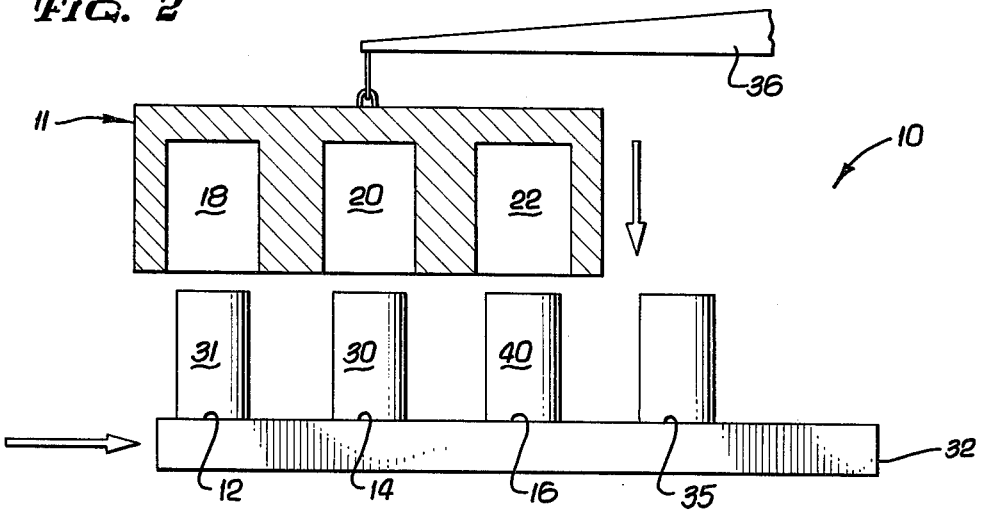
FIG. 2 is an elevational diagrammatic view of the furnace illustrating the transport of the charges from one furnace section to the next.

Referring now to FIGS. 1 and 2, a method of moving a charge 30 from one furnace station to the next can be seen. The charge is positioned on a transfer platform 32. The platform moves the charge from a loading station 34 to the preheating station 12 of the furnace system. As can be seen in FIG. 2, a lifting bar 36 raises the furnace to allow the platform to move the charges from one station to the next. Once the charges are positioned in the appropriate stations, the furnace compartments are lowered.

The raising and lowering of the furnace compartments can be accomplished by using any conventional means such as the lift bar 36 which may be connected to any lifting machinery (not shown). A particular lifting arrangement which uses a very small amount of energy is described in detail below.

As indicated, each charge undergoes three phases in its annealing cycle in this unique energy saving furnace system. In order to facilitate the continuous operation of the furnace system each phase must be, of course, of the same time duration as each other phase. For example, the charge 30, in FIG. 1 finishes its preheating phase at the same time as a charge 40 finishes its heating phase and thus can be moved simultaneously to the next stations as shown in FIG. 2. At the completion of each phase the furnace is raised and the platform 32 advances the charges to the next stations, while moving a new charge 31 from the loading station into the preheating station. In this way the furnace compartments are raised four times in every cycle: when a charge enters the preheating station, when the charge enters the heating station, when the charge enters the cooling station and when the charge moves to an unloading station 35.

Figure 3:
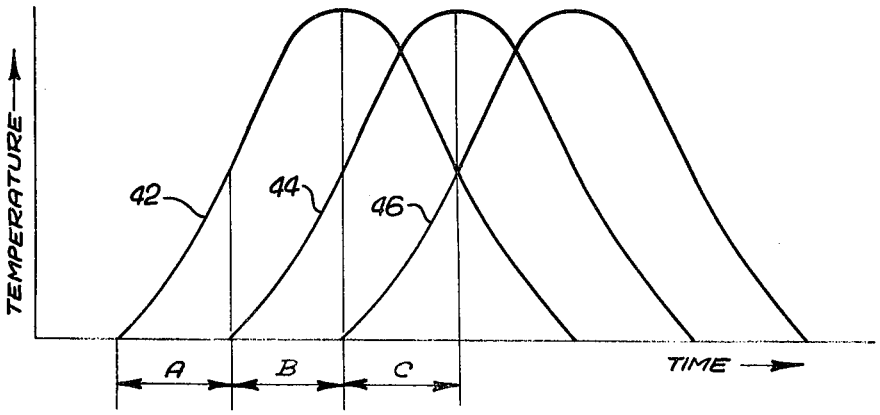
FIG. 3 is a continual operation graph illustrating the temperature of successive charges as a function of time.

It should be noted, that since all three phases are in process at the same time, once the furnace system is put into complete operation each time that the furnace compartments are raised a cycle for a particular charge is ended. FIG. 3 illustrates a continual operation diagram emphasizing this point. Examining the diagram in more detail, line 42 illustrates the temperature of a charge as a function of time, the line designated as 44 represents the temperature of the next succeeding charge as a function of time, and the line designated as 46 represents the temperature of the second succeeding charge as a function of time. The charge associated with line 42 is in the preheating phase during the time interval represented by the letter A, whereas the charge associated with line 44 is in the preheating phase during the time interval represented by B. During the time interval indicated by the letter C, the charge associated with line 42 is in the cooling phase, the charge associated with line 44 is in the heating phase, and the charge associated with line 46 is in the preheating phase. As can be readily appreciated from the Figure, once the furnace is put into operation a charge will always be preheating, one will always be heating, and another will always be cooling. This processing of three charges simultaneously increases the furnace yield per unit of time.

Referring again to FIG. 4 an embodiment of the invention with a convenient and efficient manner of transporting the charge from one station of the furnace to the next can be seen. Specifically, a rotatable pentagonal table 48 contains five charge positions equally spaced about the perimeter of the pentagon. Presses 50, FIG. 5, together with their air pressure cylinders, described in more detail below, are positioned on the table 48 at each of the charge locations. The presses and associated equipment rotate with the table.

Figure 4:
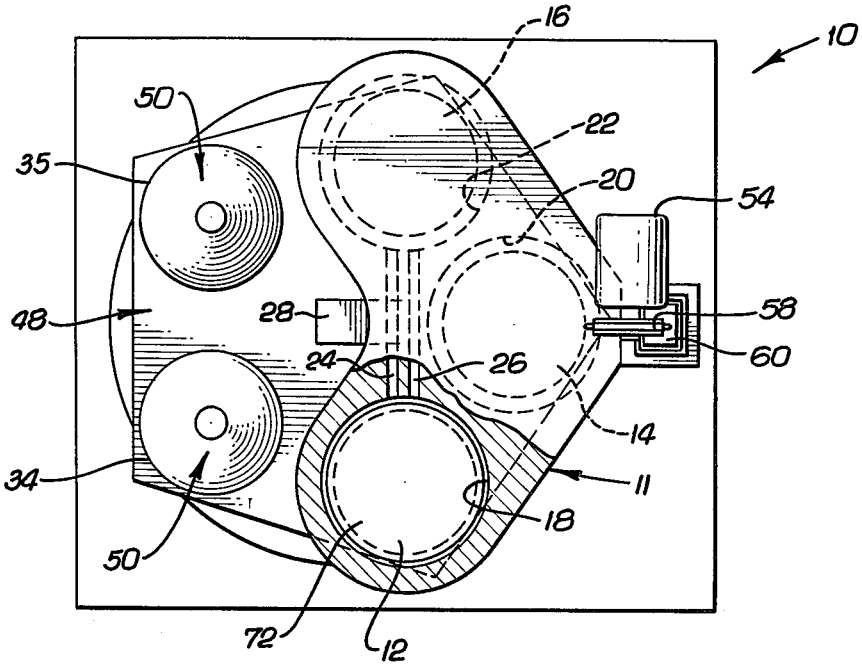
FIG. 4 is a top plan view showing the furnace with its three compartments and a rotatable table for transporting the charges.

As can be seen in FIG. 4, the furnace compartments are arranged in a triangular configuration conforming to the pentagonal shape of the table. The angle formed by the intersection of lines connecting the preheating compartment 18 with the heating compartment 20 and the lines connecting the cooling compartment 22 with the heating compartment 20 is 109°. As previously described, the preheating compartment 18 and the cooling compartment 22 are in thermal communication with each other. The fan 28 draws air from the preheating compartment 18 and forces that air into the cooling compartment 22 via the duct 24. Due to a pressure difference created by the fan hot air from the cooling compartment 22 is transferred via the duct 26 to the preheating compartment 18. The table is rotated by any convenient means such as an air cylinder 71, linkage arrangement 73.

Figure 5:
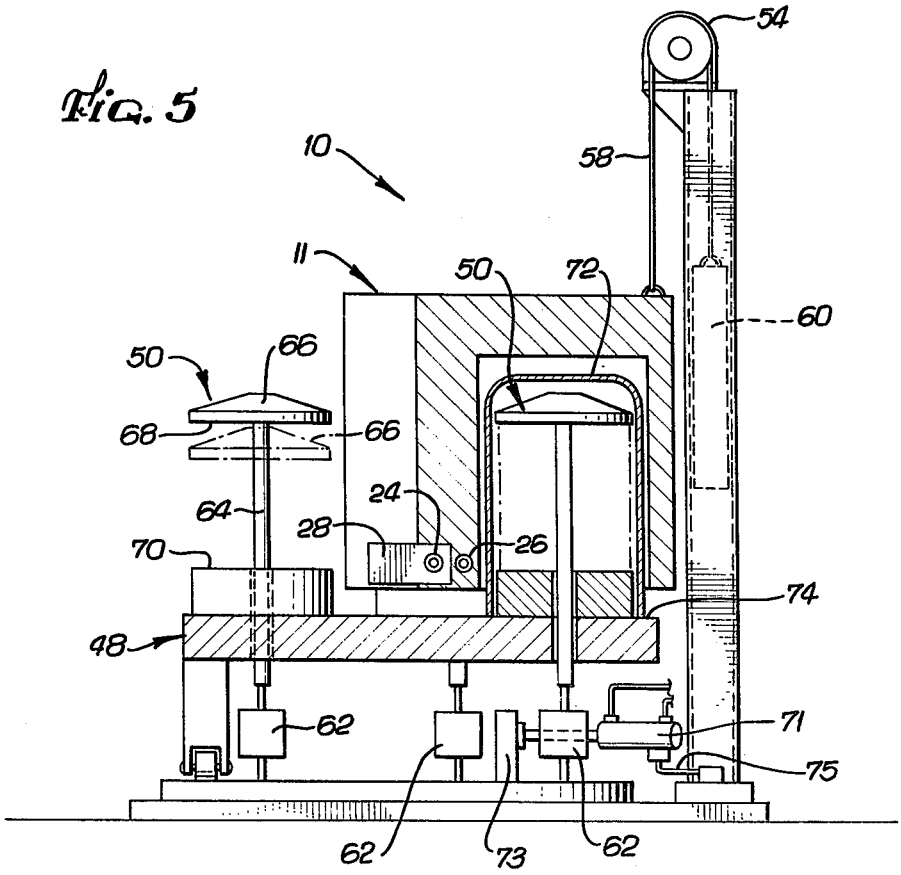
FIG. 5 is a side elevational view showing the furnace, a lifting mechanism and a pressure mechanism.

A mechanism for lifting the furnace compartments is displayed in detail in FIG. 5. This lifting mechanism comprises a motor 54, a chain 58, and a counterbalance 60. The weight of the counterbalance is selected to nearly match that of the furnace 11. Therefore the motor 54 requires very little energy to raise and lower the compartments. The weight of the furnace should be slightly greater than the counterbalance in order to insure that the furnace stays securely in place when lowered. The lifting mechanism is synchronized by mechanical linkage 75 to operate with the rotation of the table.

As noted above, steel laminations used in electric motors and transformers must have flat surfaces. It will be recalled that annealing steel laminations frequently causes distortions in the shape of the laminations due to the release of stress in the material. The unique furnace described herein not only conserves energy but also facilitates the distortion free annealing of steel laminations.

Still referring to FIG. 5, it can be seen that distortions in the shape of the annealed charge are avoided by subjecting the charge to pressure during the annealing cycle. The presses 50 are adapted to provide this pressure. Each press may be driven by a pneumatic piston and cylinder arrangement 62 as shown, or by any suitable means well known in the art.

A rod 64 connects the driving arrangement 62 to a press plate 66. The piston is driven downwardly by air pressure to the cylinder to lower the press plate and apply pressure to the charge. Thus by adjusting the air pressure in the cylinder the appropriate amount of pressure can be applied to the charge by the press plate 66.

A bottom surface 68 of the press plate is essentially flat. This flat surface is forced against the upper surface of a stacked laminated steel charge. The charge's lower surface rests upon a flat base surface 70. These two flat surfaces tightly press against the charge to prevent the rearrangement of the strain fields from affecting the planarity of the laminates. It is noted that the pressure system need be used only when the annealed charge must have flat surfaces. Thus it is ideal for steel laminations used for electric motors and transformers, especially "C" and "E" type strip wound magnetic cores where planarity is of extreme importance.

A stainless steel cylindrical cover 72 incases both the charge and the press. This cover is sealed against the table at its base 74. The cylindrical cover allows the charge to be annealed in a controlled atmosphere such as deoxidized dry nitrogen or similar mixture.

In operation, a charge to be annealed is placed on the table 48 at the loading station 34. The press 50 is activated to place the charge under the desired pressure. By applying pressure to the charge during the annealing cycle no distortions in the shape of the charge are produced. Thus a very significant problem in the annealing of the steel laminates for electric motors and transformers is solved by the present invention.

The cylindrical cover 72 is placed over the charge and the press and sealed at its base 74. Before sealing, the cylindrical cover is filled with the desired atmosphere. The motor 54 raises the furnace and the table rotates placing the charge under the preheating compartment and the furnace is lowered. Assuming that the furnace system has been in continual operation, the heat transfer fan 28 effects an exchange of thermal energy from the cooling charge in the cooling station 16 of the furnace to the preheating charge in the preheating station 12 of the furnace. It is noted that a charge in the heating station 14 of the furnace is being heated at the same time.

Figure 6:
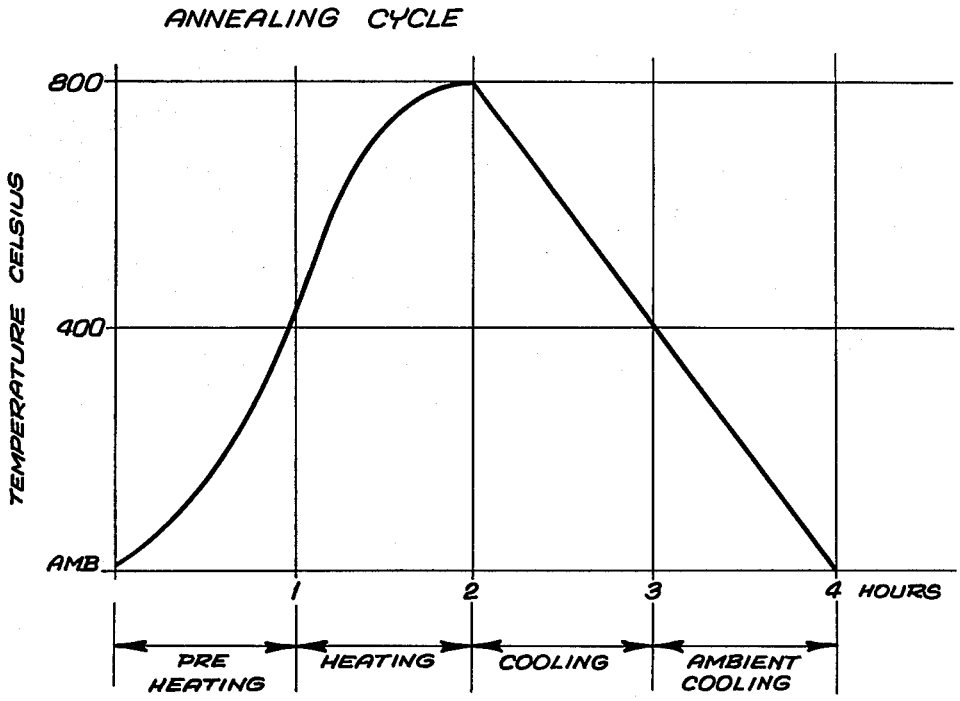
FIG. 6 is a graph of the annealing cycle of a charge showing the temperature of the charge as a function of time.

FIG. 6 illustrates the change in temperature of the charge as a function of time. It can be seen that after one hour the charge in the preheating station of the furnace has reached a temperature of about 400° C. It is noted that the temperature of the charge in the cooling station of the furnace is reduced to about 400° C. at the same time. After the furnace is raised and the table advanced, the preheated charge is positioned in the heating station of the furnace and the furnace is lowered. One hour later the charge has reached a temperature of 800° C., the desired peak temperature, and the furnace compartments are again raised and the table advanced to place the charges in their next positions. The unloading station 35 (FIG. 1) is the final position of a charge where it remains until it has reached ambient temperature and is removed. Therefore, once the furnace is put into continuous operation a charge is completely annealed and ready for removal every hour. The capacity of the furnace is twenty four charges a day, which is significantly greater than the standard annealing furnace capacity.

Figure 7:
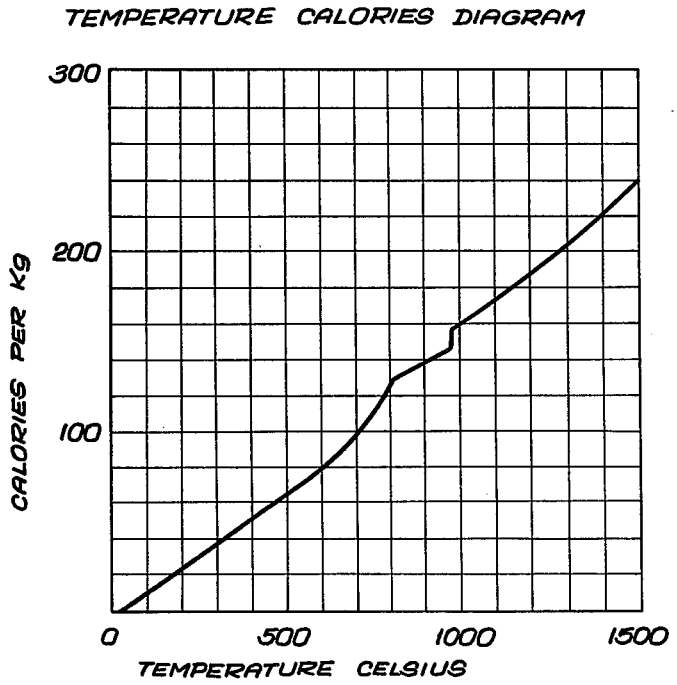
FIG. 7 is a graph of calories expended versus temperature for a kilogram of steel charge.

The thermal efficiency of the furnace is exhibited by the diagram of FIG. 7. The diagram illustrates the calories required per kilogram of steel as a function of the temperature of the steel. Thus to raise the temperature of one kilogram of steel from 0° C. to 800° C. requires about 130 calories. But to raise that same kilogram of steel from 400° C. to 800° C. requires only 80 calories. Thus by preheating the charge from the heat given off by a cooling charge, 50 calories per heating cycle are saved. Those 50 calories represent a 38% savings of the total energy of the cycle.

What has been described is a simple and easy to construct yet highly efficient furnace system for annealing. A method of efficiently annealing steel or other materials has also been shown. As has been explained, the furnace system is extremely effective for distortion free annealing of steel laminations. The press feature of the invention is especially useful in connection with steel laminations used in electric motors and transformers.

The furnace system disclosed herein not only results in substantial energy savings over the annealing cycle but also boasts a higher capacity per day than conventional furnaces.

I claim:

1. An annealing furnace for annealing a series of articles that are subject to deformation from planarity during such annealing, such as but not limited to metallic flat laminations and especially magnetic-grain-oriented silicon alloy "C" or "E" electrical cores; said furnace comprising:

a preheating station for applying to each such article heat given off by cooling of a preceding such article in the series;

a heating station for applying to such article heat developed by such furnace;

a cooling station for directing heat from such article to preheat a succeeding such article in the series, and thereby to partially cool such article in the cooling station;

a movable transfer platform adapted to receive and support a plurality of such articles at defined positions on the platform and to move such articles through the preheating, heating, and cooling stations in sequence; and a clamping mechanism carried on the transfer platform and adapted to forcibly clamp each such article while it is in at least the heating and cooling stations.

2. The furnace of claim 1 wherein the clamping mechanism comprises:

a plurality of pairs of opposed substantially planar surfaces, respectively disposed at opposite points relative to the said positions at which such articles are to be received and supported; and means for moving the surfaces toward each other and into forcible engagement with such article.

3. The furnace of claim 1 wherein the clamping mechanism comprises:

a plurality of pairs of substantially horizontal opposed surfaces, respectively disposed above and below the positions at which such articles are to be received and supported, a first one of each pair of opposed surfaces being upward-facing, and being defined as a supporting surface for at least one such article on the transfer platform, and the second of each pair of opposed surfaces being substantially horizontal, and being operable to move downward toward the said supporting surface and into forcible engagement with such at least one article; and means for effecting relative motion of the surfaces toward each other and for bringing the second said surface into forcible engagement with such article.

4. The furnace of claim 3 wherein the surfaces are substantially planar.

5. The furnace of claim 1 wherein the transfer platform is adapted to carry such articles from the loading station and through the preheating, heating and cooling stations to the unloading station.

6. The furnace of claim 5 wherein the clamping mechanism is adapted for clamping of such articles in the loading station and for maintenance of the clamping through the preheating, heating and cooling stations to the unloading station.

7. The furnace of claim 2 wherein the transfer platform is adapted to carry such articles from the loading station through the preheating, heating and cooling stations to the unloading station.

8. The furnace of claim 7 wherein the clamping mechanism is adapted for clamping of such articles in the loading station and for maintenance of the clamping through the preheating, heating and cooling stations to the unloading station.

9. The furnace of claim 3 wherein the transfer platform is adapted to carry such articles from the loading station through the preheating, heating and cooling stations to the unloading station.

10. The furnace of claim 9 wherein the clamping mechanism is adapted for clamping of such articles in the loading station and for maintenance of the clamping through the preheating, heating and cooling stations to the unloading station.

* * * * *